US007044790B2

(12) United States Patent
Zhu et al.

(10) Patent No.: US 7,044,790 B2
(45) Date of Patent: May 16, 2006

(54) ELECTRICAL CONNECTOR WITH ELECTRICALLY CONNECTING INNER AND OUTER SHELLS

(75) Inventors: ZiQiang Zhu, Kunsan (CN); Jinkui Hu, Kunsan (CN); Guohua Zhang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/925,063

(22) Filed: Aug. 23, 2004

(65) Prior Publication Data

US 2005/0042923 A1 Feb. 24, 2005

(30) Foreign Application Priority Data

Aug. 23, 2003 (CN) ..... 03 2 78061

(51) Int. Cl.
*H01R 13/648* (2006.01)

(52) U.S. Cl. ..... 439/607; 439/541.5

(58) Field of Classification Search ..... 439/607, 439/541.5, 608, 609, 610, 108
See application file for complete search history.

(56) References Cited

U.S. PATENT DOCUMENTS 6,086,420 A * 7/2000 Wu ..... 439/607
6,347,961 B1 * 2/2002 Zhu et al. ..... 439/607
6,827,610 B1 * 12/2004 Lin ..... 439/607

* cited by examiner

*Primary Examiner*—Chandrika Prasad
(74) *Attorney, Agent, or Firm*—Wei Te Chung

(57) ABSTRACT

An electrical connector (1) includes an insulative housing (10), a terminal subassembly (90) having a number of terminals (20, 30) received in the insulative housing, an inner shell (60) received in the insulative housing, an outer shell (71) enclosing the insulative housing and a shielding clip (80) assembled on the insulative housing. The clip includes an inner contacting portion (83) for electrically connecting with inner shell and an outer contacting portion (82) for electrically connecting with the outer shell.

19 Claims, 8 Drawing Sheets

ELECTRICAL CONNECTOR WITH ELECTRICALLY CONNECTING INNER AND OUTER SHELLS

BACKGROUND OF THE INVENTION

1. Field of the Invention

The present invention generally relates to an electrical connector, and particularly to an electrical connector for high-speed data transmission application connector.

2. Description of Prior Arts

With the development of communication and computer technology, electrical connectors for high-speed data transmission are widely used in electronic systems. U.S. Pat. Nos. 6,280,209 and 6,315,608 both disclose such electrical connectors for high-speed data transmission.

The connectors disclosed in the above-mentioned patents each comprises an insulative housing having a base portion and a mating portion, a plurality of conductive terminals retained in the housing, an inner shell enclosing the mating portion of the housing for electromagnetic interference protection, and an outer metal shell enclosing both the housing and the inner shell for further electromagnetic interference protection. The outer shell electrically connects to the grounding circuits of a printed circuit board, on which the connector is mounted. The inner shell has foot portion for mounting to the print circuit board to provide a connection to a ground on the circuit board. Obviously, when a high profile connector having a mating portion located relatively far from the printed circuit board is in use, it is very difficult to connect such inner shell to the printed circuit board on the above-mentioned way.

Hence, it is desirable to have an improved electrical connector to overcome the above-mentioned disadvantages of the prior art.

BRIEF SUMMARY OF THE INVENTION

Accordingly, it is an object of the present invention to provide an electrical connector which can establish a reliable electrical connection between an inner shell thereof and a printed circuit board.

An electrical connector in accordance with the present invention comprises an insulative housing, a terminal subassembly having a plurality of terminals received in the insulative housing, an inner shell received in the insulative housing, an outer shell enclosing the insulative housing and a shielding clip assembled on the insulative housing. The clip comprises an inner contacting portion electrically connecting with the inner shell and an outer contacting portion electrically connecting with the outer shell.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
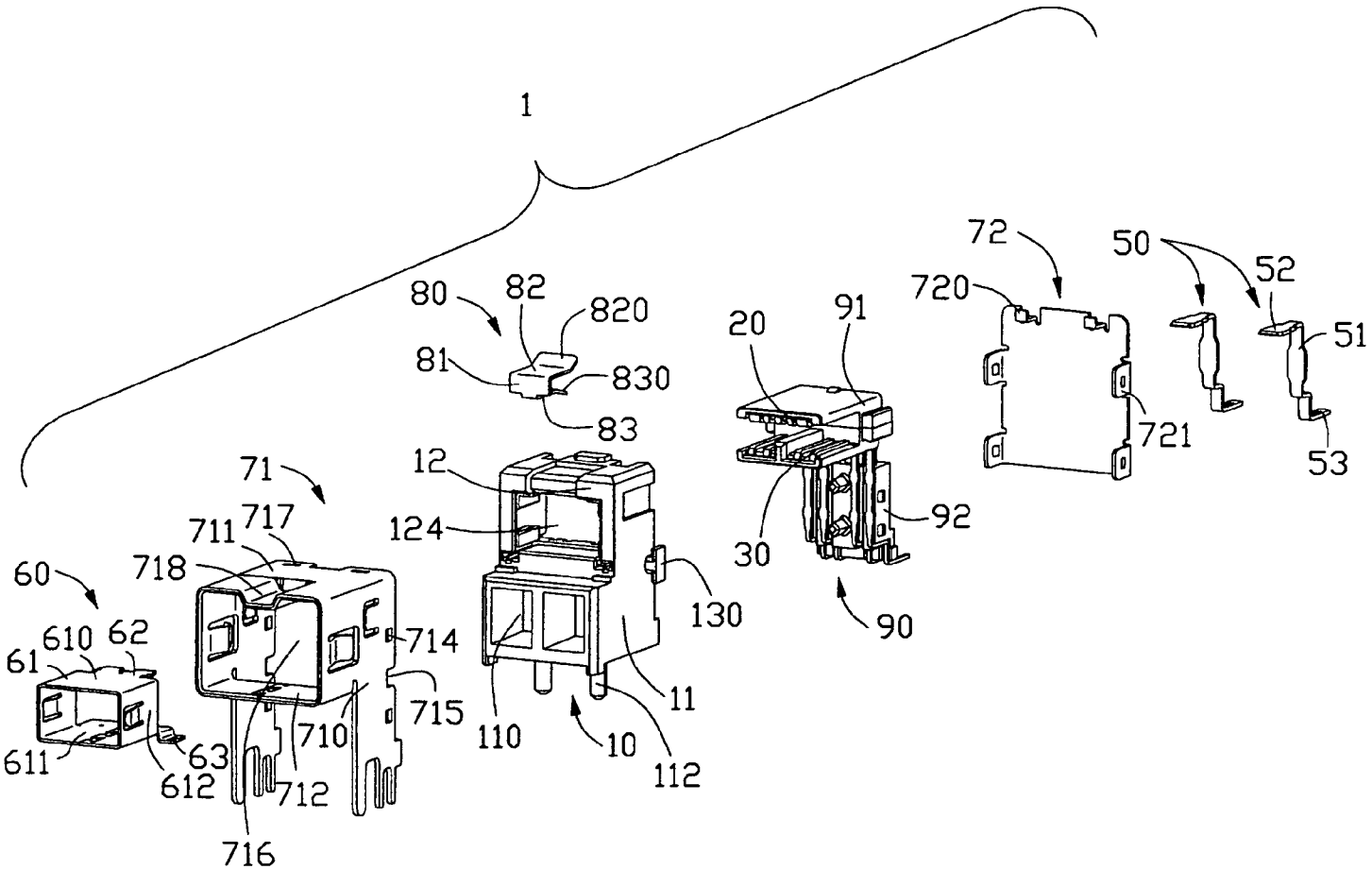
FIG. 1 is an exploded, perspective view of an electrical connector in accordance with the present invention.

Reference will now be made to the drawing figures to describe the present invention in detail.

Figure 2:
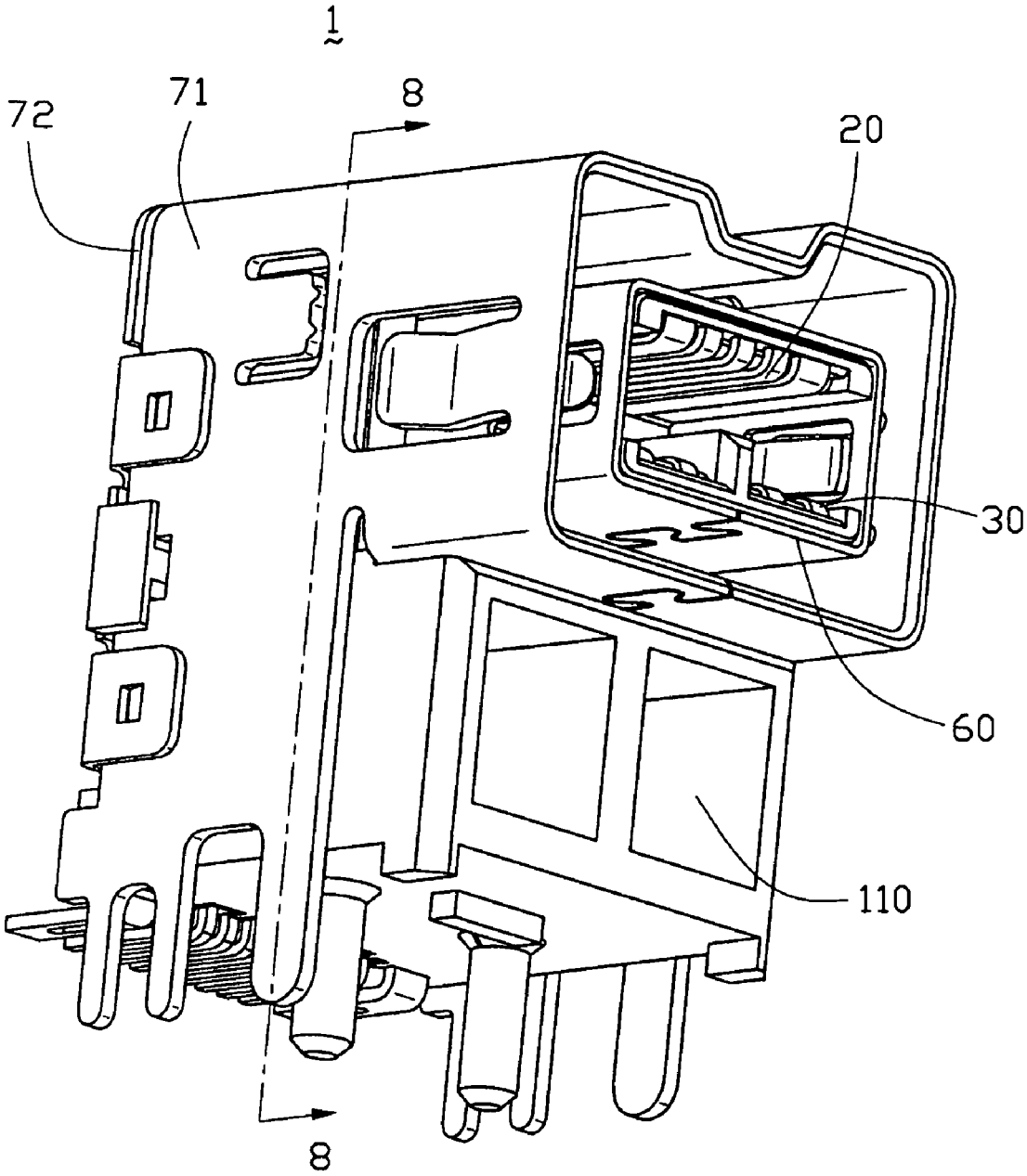
FIG. 2 is an assembled, perspective view of the electrical connector shown in FIG. 1.

With reference to FIGS. 1–2, an electrical connector 1 in accordance with the present invention and adapted for mounting on a printed circuit board (PCB, not shown) comprises an insulative housing 10, a terminal subassembly 90, an inner shell 60, an outer shell 71, a rear shell 72, a grounding member 50 and a shielding clip 80.

Figure 3:
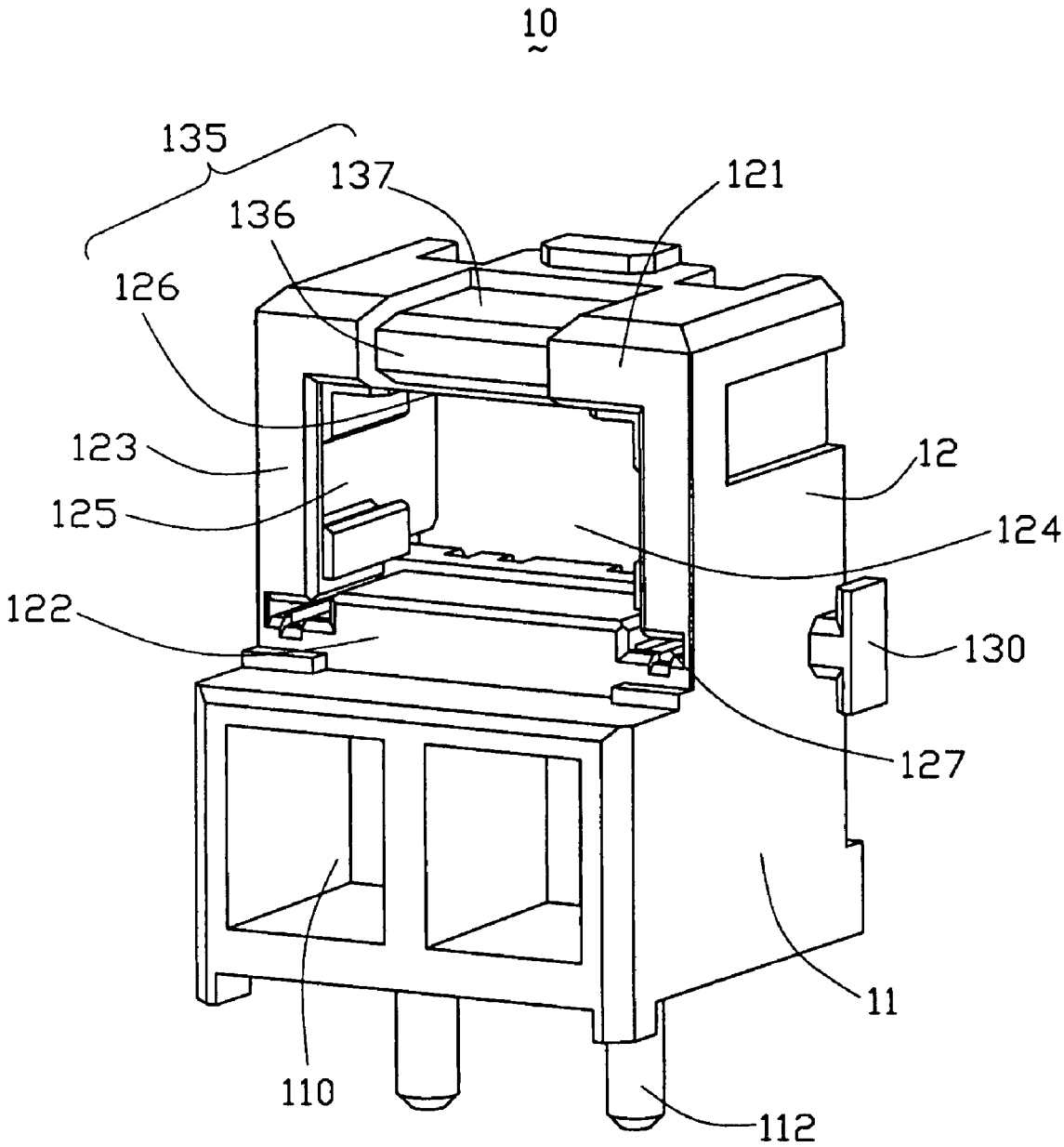
FIG. 3 is a front perspective view of an insulative housing of the electrical connector.

Referring to FIG. 3, the insulative housing 10 comprises a supporting portion 11 and a mating portion 12 extending upwardly from the supporting portion 120. The supporting portion 11 defines a pair of chambers 110 extending rearwardly from a front face thereof for saving material and a plurality of posts 112 extending downwardly from a bottom face thereof for properly positioning the electrical connector 1 on the PCB. The mating portion 12 comprises opposite upper and lower walls 121, 122 and a pair of opposite side walls 123 interconnecting the upper and the lower walls 121, 122. The upper, the lower and the side walls 121, 122, 123 define a receiving space 124 therebetween. Each side wall 123 defines a groove 182 communicating with the receiving space 124 in an inner face thereof. The upper wall 121 defines a receiving portion 135 for receiving the shielding clip 80. The receiving portion 135 comprises a retaining slots 126 communicating with the receiving space 124, a first depression 136 defined at the front face of the upper wall 121 and a second depression 137 defined at the top face of the upper wall 121. The mating portion 12 defines a pair of channels 127 along opposite side edges of the lower wall 122 where the side walls 123 and the lower wall 122 are connected with each other.

Figure 4:
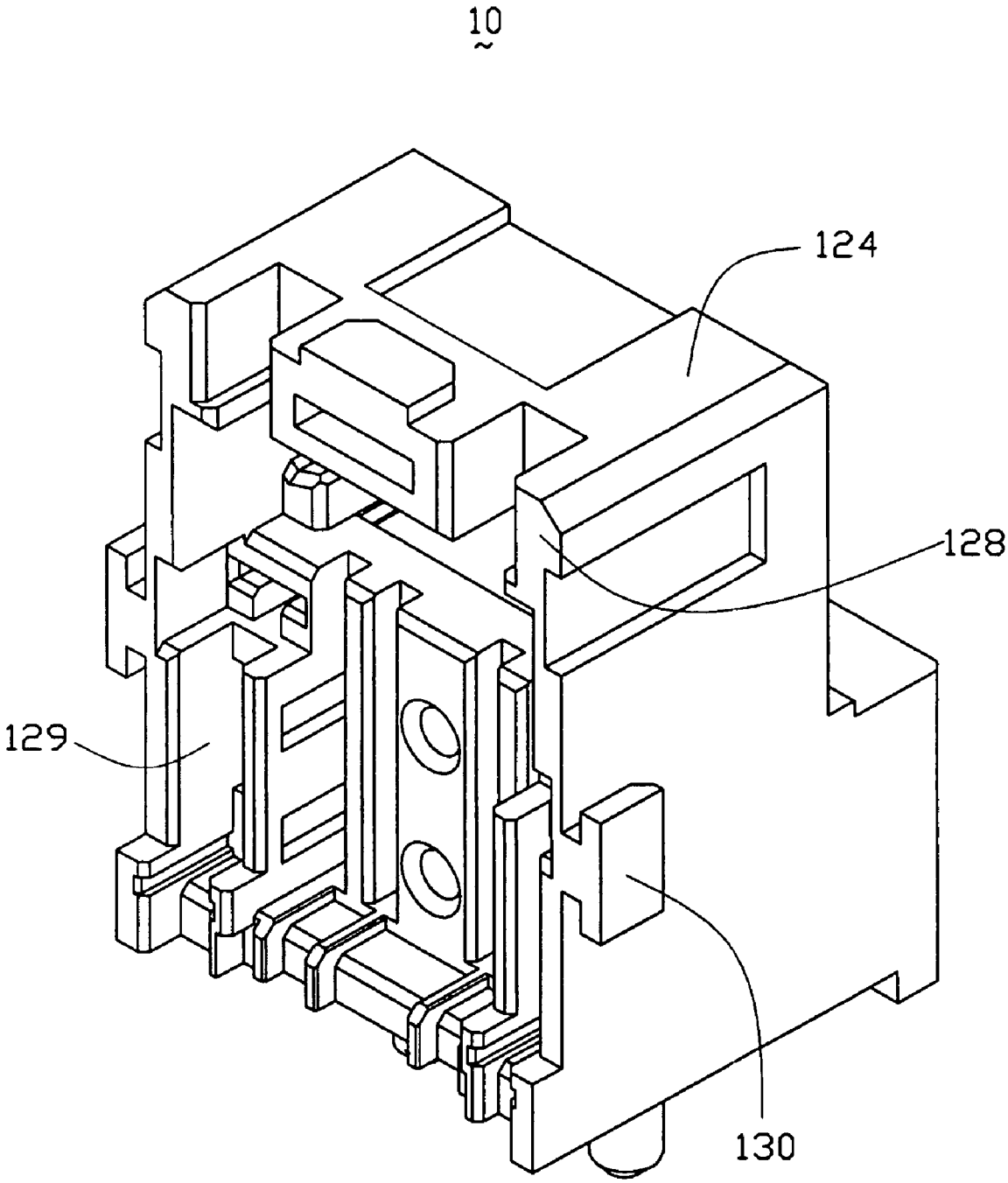
FIG. 4 is a rear perspective view of the insulative housing.

Referring to FIG. 4, the insulative housing 12 comprises a pair of slots 129 are provided on a rear face 128 thereof and communicating with the receiving space 124. A pair of T-shaped projections 130 is defined at the opposite side of the supporting portion 11.

Figure 5:
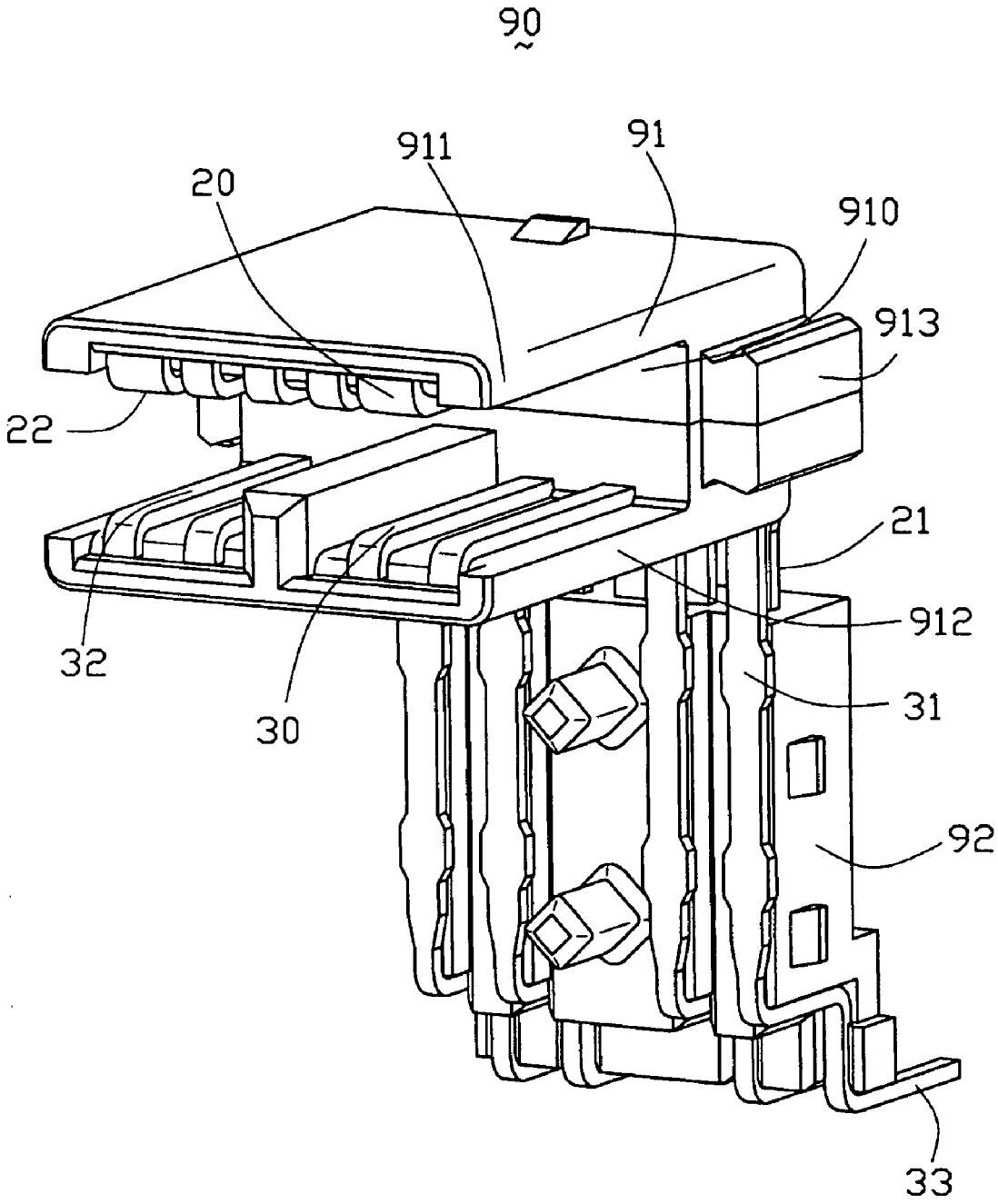
FIG. 5 is a perspective view of a terminal subassembly of the electrical connector.
Figure 6:
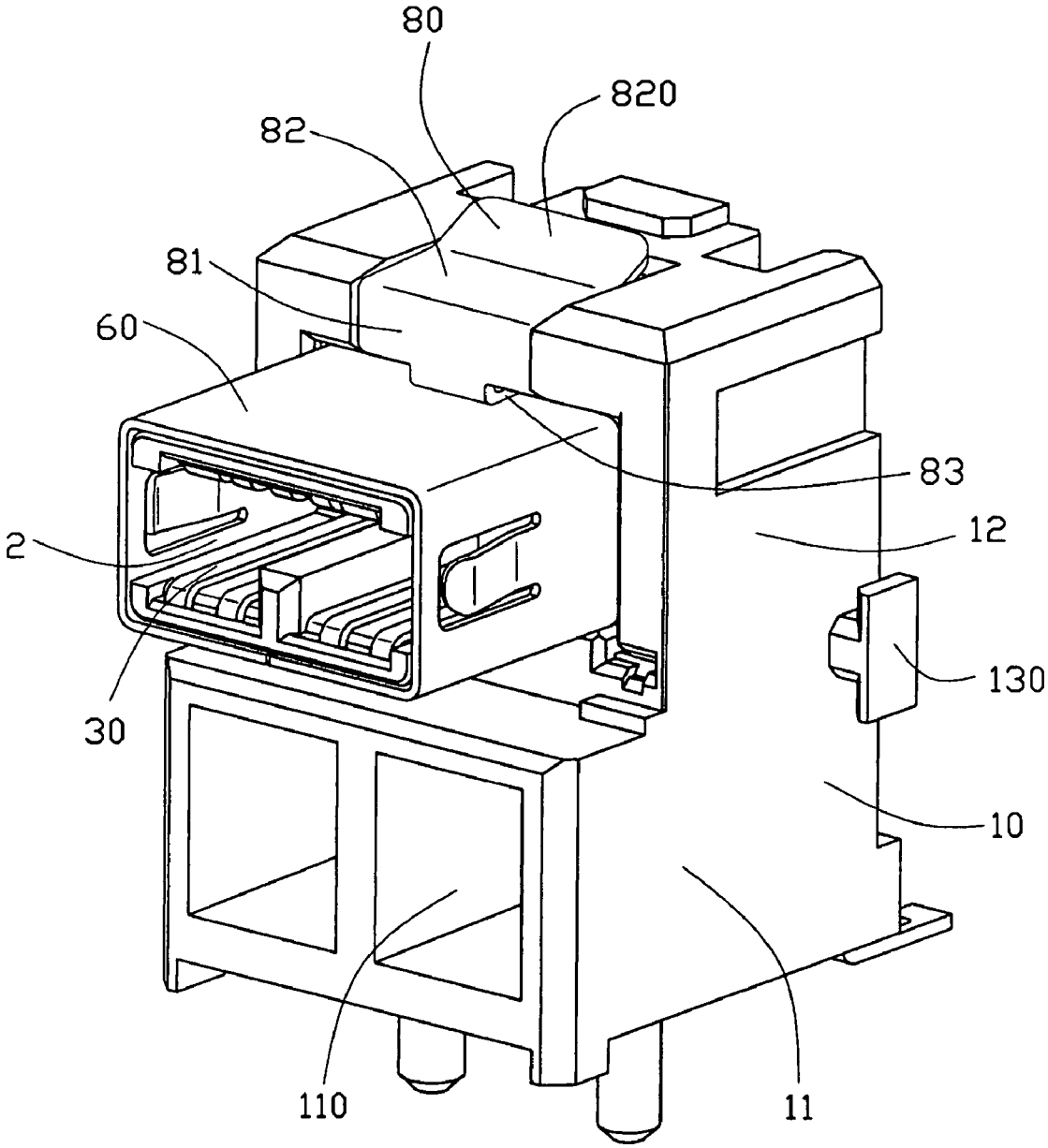
FIG. 6 is another perspective view of the electrical connector with an outer shell being removed therefrom.
Figure 7:
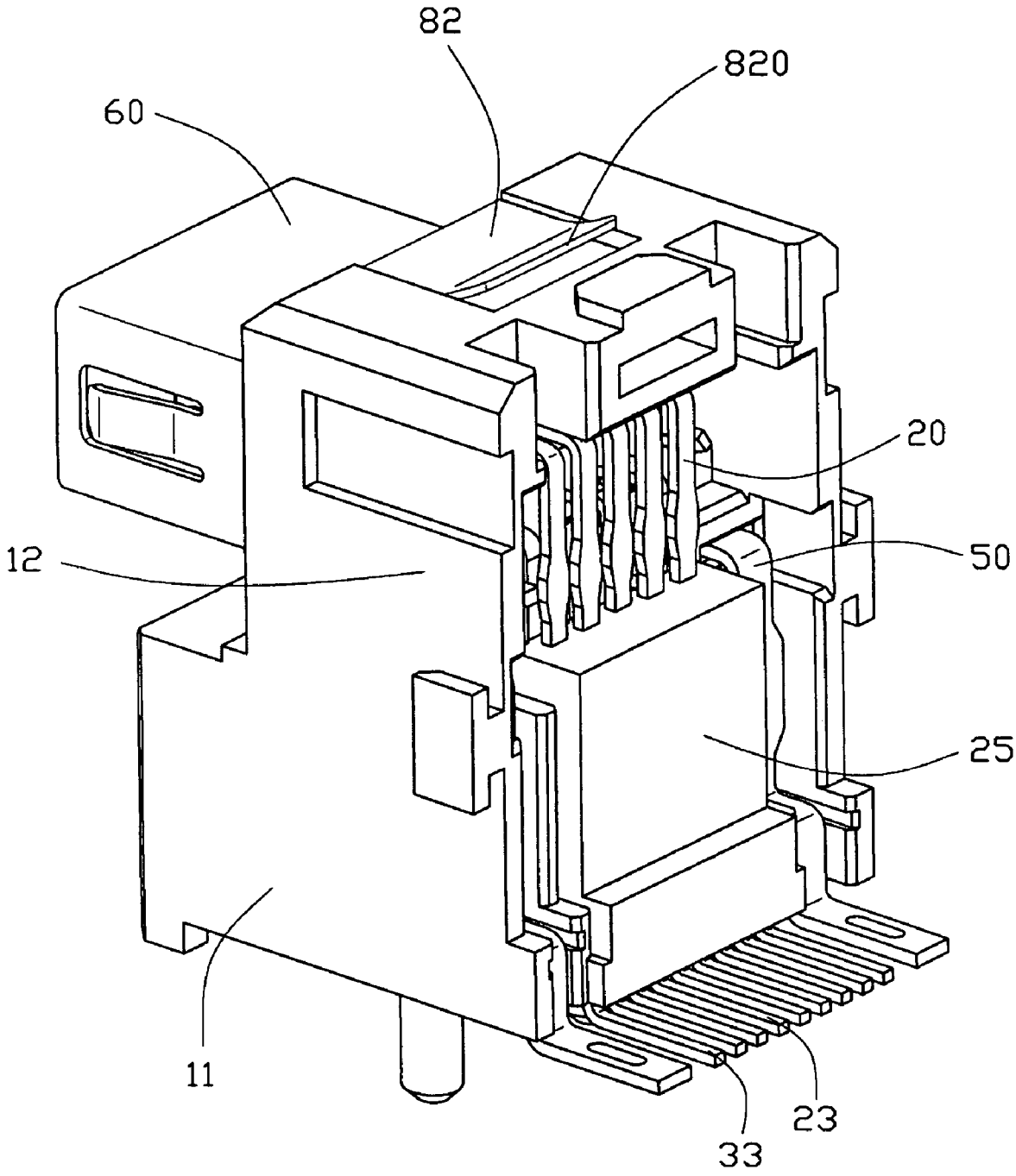
FIG. 7 is a view similar to FIG. 6 but taken from another aspect.

Turning to FIG. 5 in conjunction with FIG. 1, the terminal subassembly 90 comprises a base portion 91, a plurality of first and second terminals 20, 30 partially insert-molding in the base portion 91 and a spacer 92. The base portion 91 comprises a main body 910, a first tongue 911 and a second tongue 912 extending parallel from the front face of the main body 910 and a pair of protrusions 913 extending laterally from the opposite sides of the main body 910. Each first and second terminal 20, 30 comprises a connecting portion 21, 31, a contacting portion 22, 32 extending forwardly from the connecting portion 21, 31 and a soldering portion 23, 33 extending horizontally from the connecting portion 21, 31. The connecting portion 21 of each first terminal 20 is partially insert-molded in the spacer 92. the connecting portion 31 abuts against a front face of the spacer 92.

Figure 8:
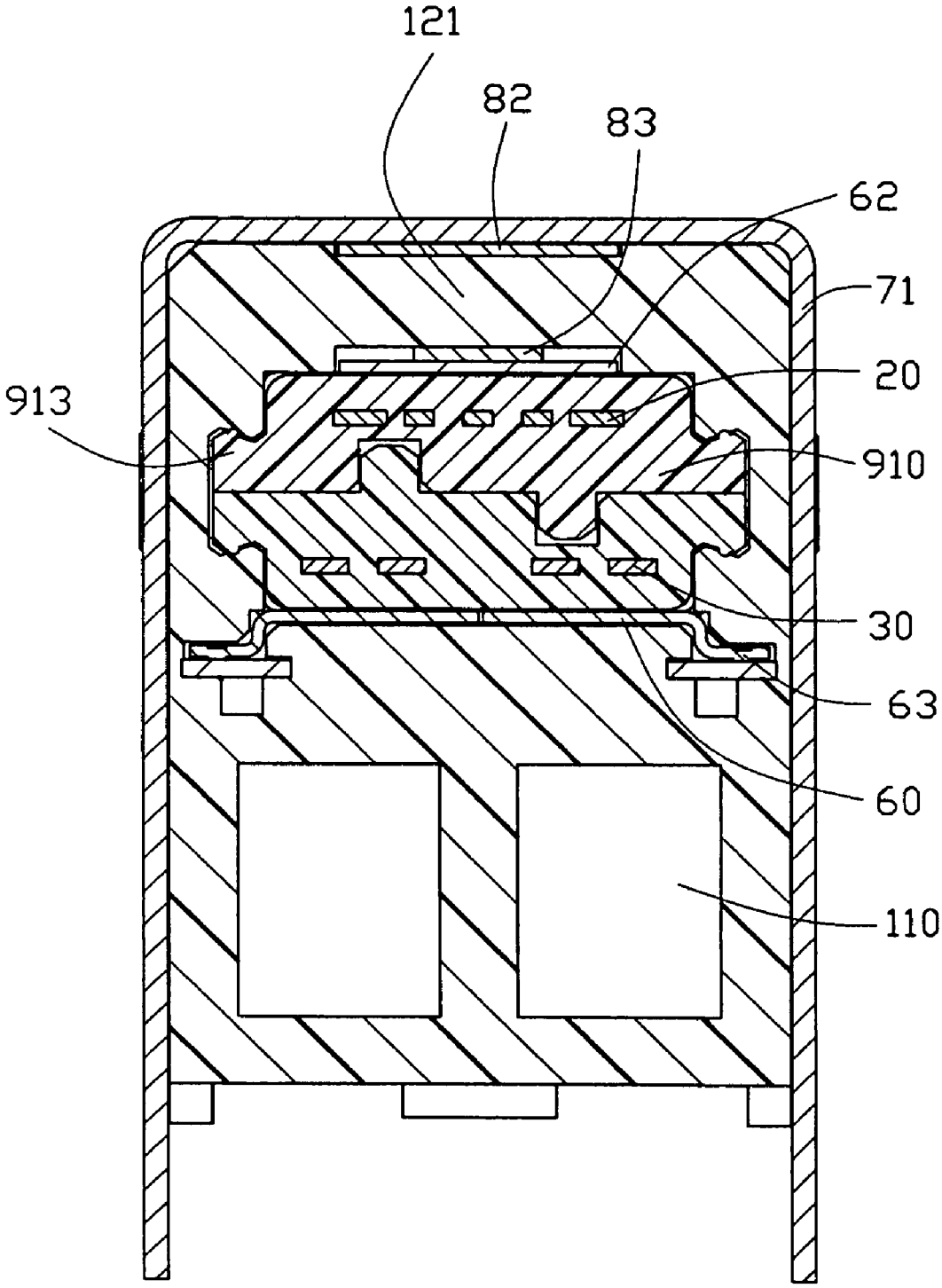
FIG. 8 is a cross-sectional view of the electrical connector taken along line 8—8 of FIG. 2.

Together referring to FIGS. 1–2 and FIG. 8, the inner shell 60 and the outer shell 70 are stamped from a piece of metal sheet, respectively. The inner shell 60 encloses the first and second tongues 911, 912 of the terminals subassembly 90 and comprises an upper wall 610, a lower wall 611, and two opposite side walls 612 extending between the upper and the lower walls 610, 611. The inner shell 60 further comprises a retaining plate 62 extending rearwardly from the upper wall 610 and an engaging plate 63 extending rearwardly and outwardly from the lower wall 611. The engaging plate 63 is received in corresponding channel 127 of the insulative housing 10 and electrically connecting with the grounding member 50 received in the channels 127. The grounding member 50 comprises a connecting portion 51, a contacting portion 52 extending forwardly in the slot 129 and a soldering portion 53 extending from the connecting portion 51 far away from the contacting portion 52 for electrically connecting with the printed circuit board.

The outer shell 71 is attached to the insulative housing 12 and defines a receiving opening 716 for further accommodating the inner shell 60 therein. Similarly, the outer shell 71 comprises a top wall 711, a bottom wall 712, and a pair of side walls 710 connecting the top and bottom wall 711, 712. Each side wall 710 has a plurality of notches 714 and a pair of opening 715 corresponding to the T-shaped projections 130 of the insulative housing 10. The top wall 711 defines a plurality of retaining openings 717 at the rear thereof and a depression portion 718 at the front thereof.

The rear shell 72 covers the rear face of the insulative housing 12 and is formed with a plurality of tabs 720 for engaging with the retaining openings 717 of the top wall 711 of the outer shell 70. A plurality of the tabs 721 are provided on opposite edges of the rear shell 72 for engaging with corresponding notches 714 opened in the side walls 710 of the outer shell 71.

The shielding clip 80 comprises a connecting portion 81, an outer contacting portion 82 and an inner contacting portion 83 extending oppositely from the connecting portion 81. The inner and the outer contacting portions 82, 83 extend rearwardly along opposite sides of the upper wall 121 of the mating portion 12 of the insulative housing 10. The inner and the outer contacting portions 82, 83 each comprise a curved, resilient end 820, 830 formed at a distal end thereof for contacting with the inner and the outer shell 60, 70, respectively.

In assembly, the terminal subassembly 90 is inserted into the mating portion 12 of the insulative housing 10 from the rear face of the insulative housing 10. The main body 910 of the base portion 91 is received in the receiving space 124 with the first and the second tongues 911, 912 projecting beyond the mating portion 12. The protrusions 913 of the base portion 91 are received in the grooves 125. Simultaneously, the spacer 92 is assembled to the rear face 128 of the insulative housing 10. The connecting portion 81 of the shielding clip 80 is received in the first depression 136, and the inner and the outer contacting portion 82, 83 of the shielding clip 80 are received in the retaining slot 126 and the second depression 137, respectively. The inner shell 60 encloses the mating portion 12. The outer shell 71 encloses the insulative housing 10 and the inner shell 60. The top wall 610 of the inner shell 60 engages with the curved end 830 of the inner contacting portion 83, and the curved end 820 of the outer contacting portion 82 engages with an inner face of the depression portion 718 of the outer shell 71. The inner shell 60 and the outer shell 71 electrically connecting with each other through the shielding clip 80. At last, the rear shell 72 is assembled to the insulative housing 10.

It should be noted here that the contacting portions 82, 83 of the shielding clip 80 have substantially resilience so that the clip 80 can be reliably retained between the outer and the inner shell 71, 60. Thus, a reliable connection between the outer and the inner shell 71, 60 and the printed circuit board is ensured.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

an insulative housing;

a terminal subassembly having a plurality of terminals and being received in the insulative housing;

an inner shell being received in the insulative housing;

an outer shell enclosing the insulative housing; and a shielding clip being assembled on the insulative housing, and shielding clip comprising an inner contacting portion electrically connecting with the inner shell and an outer contacting portion electrically connecting with the outer shell; wherein said inner shell and outer shell are not directly mechanically and electrically connected to each other but electrically connected to each other via said shielding clip.

2. The electrical connector as described in claim 1, wherein the housing comprises a lower base portion and an upper mating portion.

3. The electrical connector as described in claim 1, wherein the shielding clip comprises a connecting portion connecting the inner contacting portion and the outer contacting portion, wherein the mating portion of the insulative housing defines a depression straddle across a top wall thereof, and wherein the connecting portion of the shielding clip is received in the first depression with the inner and outer contacting portions extending rearwardly along opposite sides of the top wall.

4. The electrical connector as described in claim 1, wherein each of the inner and the outer contacting portions forms a curved, resilient end at a distal end thereof.

5. The electrical connector as described in claim 4, wherein the outer shell defines a depression portion at a top wall thereof, the outer contacting portion of the shielding clip electrically connects with an inner face of the depression portion of the outer shell, and the inner contacting portion electrically connects with a top face of the inner shell.

6. The electrical connector as described in claim 1, wherein the terminals comprise first terminals and second terminals.

7. The electrical connector as described in claim 6, wherein the terminal subassembly comprises a base portion, the first and second terminals and a spacer, the terminals partially insert-molding in the base portion.

8. The electrical connector as described in claim 7, wherein the terminal subassembly comprises a pair of mating tongues extending forwardly from the base portion, and wherein the inner shell substantially encloses the tongues of the terminal subassembly.

9. The electrical connector as described in claim 1, further comprising a rear shell enclosing a rear face of the insulative housing and electrically connecting with the outer shell.

10. The electrical connector as described in claim 1, further comprising a grounding member, the grounding member comprising a contacting portion engaging with inner shell and a soldering portion extending beyond the insulative housing for electrically connecting with a printed circuit board.

11. An electrical connector comprising:

a raised insulative housing defining an upper opening;

a terminal subassembly having a plurality of terminals and being received in the upper opening of the insulative housing;

an inner shell being received in the insulative housing and enclosing a front portion of the terminal subassembly;

an outer shell enclosing the insulative housing; and a shielding clip located and electrically connected between the inner shell and the outer shell; wherein said inner shell and said outer shell are not directly mechanically and electrically connected to each other but electrically connected to each other via said shielding clip.

12. The electrical connector as claimed in claim 11, wherein said shielding clip is located on an upper portion of the housing.

13. The electrical connector as claimed in claim 11, wherein said shielding clip is assembled to the housing.

14. The electrical connector as claimed in claim 11, wherein said shielding clip is fixed to an upper portion of the housing.

15. The electrical connector as claimed in claim 11, wherein said shielding clip is located behind and mechanically and electrically engaged with a depressed portion of the outer shell in a front-to-back direction.

16. The electrical connector as claimed in claim 11, wherein said terminal subassembly includes an insulative body with the associated terminals thereon.

17. An electrical connector comprising:

an insulative housing defining an opening;

a terminal subassembly having a plurality of terminals and being received in the opening of the insulative housing;

an inner shell being received in the insulative housing and enclosing a front portion of the terminal subassembly;

an outer shell enclosing the insulative housing; and a shielding clip located behind a depression portion of the outer shell in a front-to-back direction, and mechanically and electrically engaged with at least one of said outer shell and said inner shell in a vertical direction perpendicular to said front-to-back direction; wherein said inner shell and outer shell are not directly mechanically and electrically connected to each other but electrically connected to each other via said shielding clip.

18. The electrical connector as claimed in claim 11, wherein said shielding clip is located around a middle portion of the whole connector along a front-to-back direction thereof.

19. The electrical connector as claimed in claim 17, wherein said shielding clip is located around a middle portion of the whole connector along said front-to-back direction.

* * * * *